US008973955B2

(12) United States Patent
Ng

(10) Patent No.: US 8,973,955 B2
(45) **Date of Patent: *Mar. 10, 2015**

(54) DEVICE FOR FORMING BRUNNIAN LINKS

(71) Applicant: Choon's Design Inc., Wixom, MI (US)

(72) Inventor: Cheong Choon Ng, Novi, MI (US)

(73) Assignee: Choon's Design LLC, Wixom, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/270,635

(22) Filed: May 6, 2014

(65) Prior Publication Data

US 2014/0239635 A1 Aug. 28, 2014

Related U.S. Application Data

(63) Continuation-in-part of application No. 13/938,717, filed on Jul. 10, 2013, which is a continuation of application No. 13/227,638, filed on Sep. 8, 2011.

(60) Provisional application No. 61/410,399, filed on Nov. 5, 2010, provisional application No. 61/877,480, filed on Sep. 13, 2013.

(51) Int. Cl.

| | |
|---|---|
| ***B65H 69/04*** | (2006.01) |
| ***A44C 5/00*** | (2006.01) |
| ***D03D 29/00*** | (2006.01) |
| ***A44C 27/00*** | (2006.01) |
| ***D04D 7/02*** | (2006.01) |
| ***D04D 7/04*** | (2006.01) |
| ***D04D 11/00*** | (2006.01) |

(52) U.S. Cl.

CPC ..... *A44C 5/0069* (2013.01); *D03D 29/00* (2013.01); *A44C 27/00* (2013.01); *B65H 69/04* (2013.01); *D04D 7/02* (2013.01); *D04D 7/04* (2013.01); *D04D 11/00* (2013.01)

USPC ..... 289/17

(58) Field of Classification Search

USPC ..... 289/2, 16.5, 17, 18.1; D21/334; 273/281, 288, 309

See application file for complete search history.

(56) References Cited

U.S. PATENT DOCUMENTS

| | | | |
|---|---|---|---|
| 222,937 | A | 12/1879 | Newcomb |
| 246,648 | A | 9/1881 | Wilcox |

(Continued)

FOREIGN PATENT DOCUMENTS

| | | |
|---|---|---|
| GB | 2147918 | 5/1985 |
| JP | 2003-520083 | 7/2003 |

(Continued)

OTHER PUBLICATIONS

International Search Report & Written Opinion for International Application No. PCT/US2011/041553 mailed on Feb. 23, 2012.

(Continued)

*Primary Examiner* — Shaun R Hurley

(74) *Attorney, Agent, or Firm* — Carlson, Gaskey & Olds, P.C.

(57) ABSTRACT

A Brunnian link is a link formed from a closed loop doubled over itself to capture another closed loop to form a chain. Elastic bands can be utilized to form such links in a desired manner. The example device provides a means of creating items using Brunnian links of complex configurations. Moreover, the example kit provides a device that allows for the successful creation of unique linked items.

26 Claims, 4 Drawing Sheets

(56) References Cited

U.S. PATENT DOCUMENTS

| | | | |
|---|---|---|---|
| 254,258 | A | 2/1882 | Barbour |
| 254,288 | A | 2/1882 | Dimmick |
| 289,578 | A | 12/1883 | Stewart |
| 426,087 | A | 4/1890 | Wolkow |
| 782,657 | A | 2/1905 | Hubert |
| 843,495 | A | 2/1907 | Sander |
| 968,199 | A | 8/1910 | Schwartz |
| 1,020,963 | A | 3/1912 | Cake |
| 1,073,226 | A | 9/1913 | Freeman |
| 1,176,482 | A | 3/1916 | Orme |
| 1,279,411 | A | 9/1918 | Neuman |
| 1,318,465 | A | 10/1919 | Seifarth |
| 1,318,604 | A | 10/1919 | Schneider |
| 1,366,212 | A | 1/1921 | Pollard |
| 1,375,119 | A | 4/1921 | Stephen |
| 1,405,744 | A | 2/1922 | Sampliner |
| 1,424,458 | A | 8/1922 | Fleisher |
| 1,500,383 | A | 7/1924 | Gourie |
| 1,599,040 | A | 9/1926 | Clisby |
| 1,647,060 | A | 10/1927 | Speidel |
| 1,694,849 | A | 12/1928 | Fujii |
| 1,705,860 | A | 3/1929 | Hagihara |
| 1,718,140 | A | 6/1929 | Hagihara |
| 1,776,561 | A | 9/1930 | La Croix |
| 1,994,659 | A | 3/1935 | De A Mascarenhas |
| 2,072,668 | A | 3/1937 | Eltgroth |
| 2,108,424 | A | 2/1938 | Bakely |
| 2,134,066 | A | 10/1938 | Van Ness |
| 2,186,692 | A | 1/1940 | Boyer et al. |
| 2,270,619 | A | 1/1942 | Bowyer |
| 2,274,572 | A | 2/1942 | Yates |
| 2,318,018 | A | 5/1943 | Semonsen |
| 2,360,416 | A | 10/1944 | Gray |
| 2,433,307 | A | 12/1947 | Thomas |
| 2,450,067 | A | 9/1948 | Wolff |
| 2,457,064 | A | 12/1948 | Parisi |
| 2,540,383 | A | 2/1951 | Tillert et al. |
| 2,545,409 | A | 3/1951 | McCall |
| 2,658,364 | A | 11/1953 | Carlson |
| 2,666,249 | A | 1/1954 | Ruiz et al. |
| 2,687,630 | A | 8/1954 | Carlson |
| 2,703,482 | A | 3/1955 | Auran |
| 2,707,052 | A | 4/1955 | Brown |
| 2,726,434 | A | 12/1955 | Knoblock et al. |
| 2,984,488 | A | 5/1961 | Kirchner |
| 3,054,214 | A | 9/1962 | Smith et al. |
| 3,069,739 | A | 12/1962 | Jorgenson et al. |
| 3,112,491 | A | 12/1963 | Cleveland |
| D204,442 | S | 4/1966 | Brawley et al. |
| 3,377,674 | A | 4/1968 | Brassaw et al. |
| 3,438,098 | A | 4/1969 | Grabner |
| 3,438,223 | A | 4/1969 | Linstead |
| 3,476,423 | A | 11/1969 | Kentfield |
| 3,476,426 | A | 11/1969 | Lewin |
| 3,572,679 | A | 3/1971 | Strauff |
| 3,636,987 | A | 1/1972 | Forby |
| 3,648,484 | A | 3/1972 | Gordon |
| 3,665,971 | A | 5/1972 | Ileks |
| 3,672,679 | A | 6/1972 | Burns |
| 3,678,709 | A | 7/1972 | Nowicki et al. |
| 3,688,357 | A | 9/1972 | Nielsen et al. |
| 3,693,976 | A | 9/1972 | Flack |
| 3,728,762 | A | 4/1973 | Hogg |
| 3,748,706 | A | 7/1973 | Doyel |
| 3,758,923 | A | 9/1973 | Maude |
| 3,800,372 | A | 4/1974 | Daoust |
| 3,805,345 | A | 4/1974 | Antos |
| 3,853,021 | A | 12/1974 | Hayes |
| 3,905,133 | A | 9/1975 | Charman |
| 4,018,543 | A | 4/1977 | Carson et al. |
| 4,023,245 | A | 5/1977 | Zaltzman |
| 4,032,179 | A | 6/1977 | Goss |
| 4,037,513 | A | 7/1977 | Hobson |
| 4,066,271 | A | 1/1978 | Lohr |
| D248,347 | S | 7/1978 | McCollum |
| 4,114,892 | A | 9/1978 | Csoka |
| 4,131,138 | A | 12/1978 | Boisvert |
| 4,179,129 | A | 12/1979 | Loomis |
| 4,248,063 | A | 2/1981 | Wang |
| 4,416,040 | A | 11/1983 | Towsley |
| 4,569,108 | A | 2/1986 | Schwab |
| 4,629,100 | A | 12/1986 | Owens |
| 4,667,965 | A | 5/1987 | Helms, Jr. |
| 4,680,021 | A | 7/1987 | Maxim |
| 4,729,229 | A | 3/1988 | Whicker |
| 4,844,473 | A | 7/1989 | Landsberg |
| D310,672 | S | 9/1990 | Harvey et al. |
| D330,668 | S | 11/1992 | Nagamatsu |
| 5,163,946 | A | 11/1992 | Li |
| 5,231,742 | A | 8/1993 | Macbain |
| 5,295,280 | A | 3/1994 | Hudson et al. |
| 5,328,374 | A | 7/1994 | Stevens |
| 5,331,725 | A | 7/1994 | Chou |
| 5,377,595 | A | 1/1995 | Liu |
| 5,426,788 | A | 6/1995 | Meltzer |
| 5,437,459 | A | 8/1995 | Kirby |
| 5,459,905 | A | 10/1995 | Voyre |
| 5,577,299 | A | 11/1996 | Thompson et al. |
| 5,639,090 | A | 6/1997 | Stevens |
| 5,687,775 | A | 11/1997 | Thompson et al. |
| D389,050 | S | 1/1998 | Li |
| 5,713,094 | A | 2/1998 | Markey et al. |
| 5,888,392 | A | 3/1999 | Frizell |
| 5,927,764 | A | 7/1999 | Harriman |
| D425,784 | S | 5/2000 | Beugelsdyk et al. |
| 6,065,968 | A | 5/2000 | Corliss |
| D426,425 | S | 6/2000 | Hermanski |
| 6,122,859 | A | 9/2000 | Lazar |
| 6,129,551 | A | 10/2000 | Martin |
| 6,131,778 | A | 10/2000 | Etzion |
| 6,146,144 | A | 11/2000 | Fowler et al. |
| 6,149,436 | A | 11/2000 | Dunn |
| 6,171,317 | B1 | 1/2001 | Jackson et al. |
| 6,213,918 | B1 | 4/2001 | Rogers, Jr. |
| 6,550,177 | B1 | 4/2003 | Epple, Jr. |
| D478,738 | S | 8/2003 | Workman |
| 6,880,364 | B1 | 4/2005 | Vidolin et al. |
| 6,923,026 | B1 | 8/2005 | Clarke |
| 7,040,120 | B2 | 5/2006 | Hunter |
| D552,463 | S | 10/2007 | French et al. |
| D562,358 | S | 2/2008 | Landmesser |
| D563,997 | S | 3/2008 | Gustin |
| D570,923 | S | 6/2008 | Vazquez Gastellu |
| D578,383 | S | 10/2008 | Adams |
| 7,506,524 | B2 | 3/2009 | Gustin |
| D592,537 | S | 5/2009 | Darnell |
| 7,578,146 | B2 | 8/2009 | Gustin |
| 7,617,947 | B2 | 11/2009 | Schafer |
| D608,189 | S | 1/2010 | Jackson et al. |
| 7,909,609 | B2 | 3/2011 | Molin |
| D635,594 | S | 4/2011 | Novak |
| 8,316,894 | B2 | 11/2012 | Schaub |
| 8,402,794 | B2 | 3/2013 | Sasur |
| 8,418,434 | B1 | 4/2013 | Carruth et al. |
| 8,485,565 | B2 | 7/2013 | Ng |
| D690,191 | S | 9/2013 | Takakuwa et al. |
| 8,622,441 | B1 * | 1/2014 | Ng ..... 289/17 |
| 8,684,420 | B2 * | 4/2014 | Ng ..... 289/17 |
| D711,931 | S | 8/2014 | Daftari |
| 2007/0114340 | A1 | 5/2007 | Adams |
| 2007/0199965 | A1 | 8/2007 | Gouldson |
| 2008/0156043 | A1 | 7/2008 | Gustin |
| 2008/0223083 | A1 | 9/2008 | Gustin |
| 2009/0215013 | A1 | 8/2009 | Molin |
| 2010/0019495 | A1 | 1/2010 | Oliveto |
| 2011/0152946 | A1 | 6/2011 | Frigg et al. |
| 2011/0259465 | A1 * | 10/2011 | Schaub ..... 139/29 |
| 2012/0047960 | A1 | 3/2012 | Sasur |
| 2012/0112457 | A1 | 5/2012 | Ng |
| 2013/0020802 | A1 | 1/2013 | Ng |

(56) References Cited

U.S. PATENT DOCUMENTS

| | | | | |
|---|---|---|---|---|
| 2013/0300114 | A1 | 11/2013 | Ng | |
| 2013/0307267 | A1* | 11/2013 | Ng | 289/1.5 |

FOREIGN PATENT DOCUMENTS

| | | |
|---|---|---|
| JP | 2004-520910 | 7/2004 |
| KR | 10-2001-0012609 | 2/2001 |
| KR | 10-2006-0042108 | 5/2006 |

OTHER PUBLICATIONS

International Preliminary Report on Patentability for International Application No. PCT/US2011/041553 mailed on May 16, 2013.
Petition for Inter Partes Review of U.S. Patent No. 8,485,565 and Exhibits, filed in the United States Patent and Trademark Office.
United States Design U.S. Appl. No. 29/468,891, filed Oct. 24, 2013, entitled "Brunnian Link Forming Loom".
How to Make Rubber Band Bracelets Using Twistz Bandz—Instruction #1; http://www.youtube.com/watch?v=6nlnnVEjrLU; Mar. 28, 2011.
Various rubber band crafts and bracelets using Rainbow Loom®; http://www.youtube.com/watch?v=oM6sOkZFz5o; Mar. 30, 2011.
How to make "Diamond" pattern rubber band bracelet using the Rainbow Loom® Kit; http://www.youtube.com/watch?v=dZa8dpZasKA; Jun. 8, 2011.
(Rainbow Loom®) Twistz Bandz product—with bloopers; http://www.youtube.com/watch?v=DbzS5u8ib_0; Jul. 6, 2011.
Defendants' Preliminary Non-Binding Invalidity Contentions, *Choon's Design LLC* V. *Zenacon, LLC et al*., United States District Court for the Eastern District of Michigan, Case No. 2:13-cv-13568-PJD-RSW, Mar. 7, 2014.
Decision to Institute of Inter Partes Review of US Patent No. 8485565 dated May 20, 2014, Case IPR2014-00218, from the United States Patent and Trademark Office.
Petitioner's Request for Rehearing Under 37 CFR §42.71(d) filed on Jun. 3, 2014, Case IPR2014-00218, from the United States Patent and Trademark Office.
United States Continuation U.S. Appl. No. 13/938,717, filed Jul. 10, 2013, entitled "Brunnian Link Making Device and Kit".
United States Continuation U.S. Appl. No. 14/329,099, filed Jul. 11, 2014, entitled "Brunnian Link Making Device and Kit".
United States Continuation in Part U.S. Appl. No. 13/626,057, filed Sep. 25, 2012, entitled "Brunnian Link Making Device and Kit".
U.S. Appl. No. 14/331,456, filed Jul. 15, 2014, entitled "Hand Held Link Making Device and Kit".
U.S. Appl. No. 14/226,096 filed Mar. 26, 2014, entitled "Monster Tail Loom for Forming Brunnian Links".
Design U.S. Appl. No. 29/468,549, filed on Oct. 1, 2013, entitled "Brunnian Link Forming Loom".
United Kingdom Combined Search and Examination Report for Application No. GB1416090.1 dated Oct. 16, 2014.
United Kingdom Combined Search and Examination Report for Application No. GB1416091.5 dated Oct. 16, 2014.
International Search Report and Written Opinion for International Application No. PCT/US14/46106 mailed Oct. 18, 2014.
International Search Report and Written Opinion for International Application No. PCT/US14/54475 mailed Oct. 27, 2014.
European Search Report for EP Application No. 13840473.6 dated Jul. 3, 2014.
Takacas, Sarah (SarahLynnTea), How to Make Rubber Band Bracelets; Published Apr. 15, 2009 http://www.youtube.com/watch?v=e0k762PJ-D8.
Introduction video—Rainbow Loom (the next generation Twistz Bandz kit). Published Sep. 24, 2012. http://www.youtube.com/watch?v=FUwf3CheGuw.
Lesson 21: "Sweet Heart" Rainbow Loom Bracelet by Choon; Published Jan. 21, 2013 http://www.youtube.com/watch?v=7l8MbYceEC0.
Rainbow Loom from Choon's Design, LLC; Published Jul. 24, 2013 http://www.youtube.com/watch?v=vhiVxnbE0CE.
How to make a rainbow loom starburst bracelet; Published Aug. 1, 2013 http://www.youtube.com/watch?v=Rl7Akl5dJzo.
How To: Make the Rainbow Loom Single Band Bracelet; Published Aug. 12, 2013 http://www.youtube.com/watch?v=Wd3UdqPmKbA.
Petition for Post-Grant Review of U.S. Patent No. 8,684,420 and Exhibits, filed in the United States Patent and Trademark Office on Aug. 5, 2014, Case No. PGR2014-00008.
Petition for Inter Partes Review of U.S. Patent No. 8,485,565 and Exhibits, filed in the United States Patent and Trademark Office on Aug. 20, 2014, Case No. IPR2014-01353.
How to make a fishtail rainbow loom bracelet; http://www.youtube.com/watch?v=ukv83Cvq3jk; Jul. 13, 2013.

* cited by examiner

DEVICE FOR FORMING BRUNNIAN LINKS

CROSS REFERENCE TO RELATED APPLICATIONS

This application is a continuation-in-part of U.S. patent application Ser. No. 13/938,717 filed Jul. 10, 2013, which is a continuation of U.S. patent application Ser. No. 13/227,638 filed Sep. 8, 2011, now granted as U.S. Pat. No. 8,468,565, which claims priority to U.S. Provisional Application No. 61/410,399 filed on Nov. 5, 2010. This application also claims priority to U.S. Provisional Application No. 61/877,480 filed Sep. 13, 2013.

BACKGROUND

This disclosure generally relates to method and device for creating a linked item. More particularly, this disclosure relates to a method and device for creating a linked wearable item from elastic bands.

Kits that include materials for making a uniquely colored bracelet or necklace have always enjoyed some popularity. However such kits usually just include the raw materials such as different colored threads and beads and rely on the individual's skill and talent to construct a usable and desirable item. Accordingly there is a need and desire for a kit that provides not only the materials for creating a unique wearable item, but also that provides for ease of construction to make it easy for people of many skill and artistic levels to successfully create a desirable and durable wearable item.

SUMMARY

A Brunnian link is a link formed from a closed loop doubled over itself to capture another closed loop to form a chain. Elastic bands can be utilized to form such links in a desired manner. The example device provides a means of creating items using Brunnian links of complex configurations. Moreover, the example kit provides a device that allows for the successful creation of unique wearable items regardless of skill level.

Although the different examples have the specific components shown in the illustrations, embodiments of this invention are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
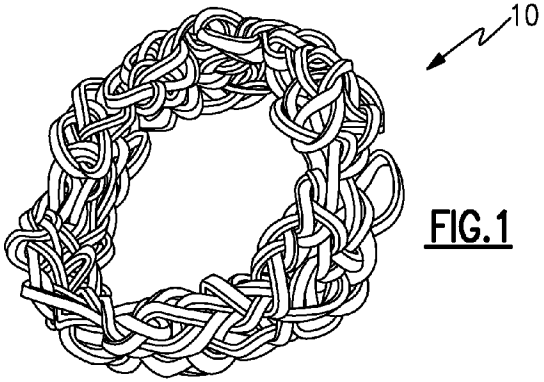
FIG. 1 is a schematic view of an example linked article.
Figure 2:
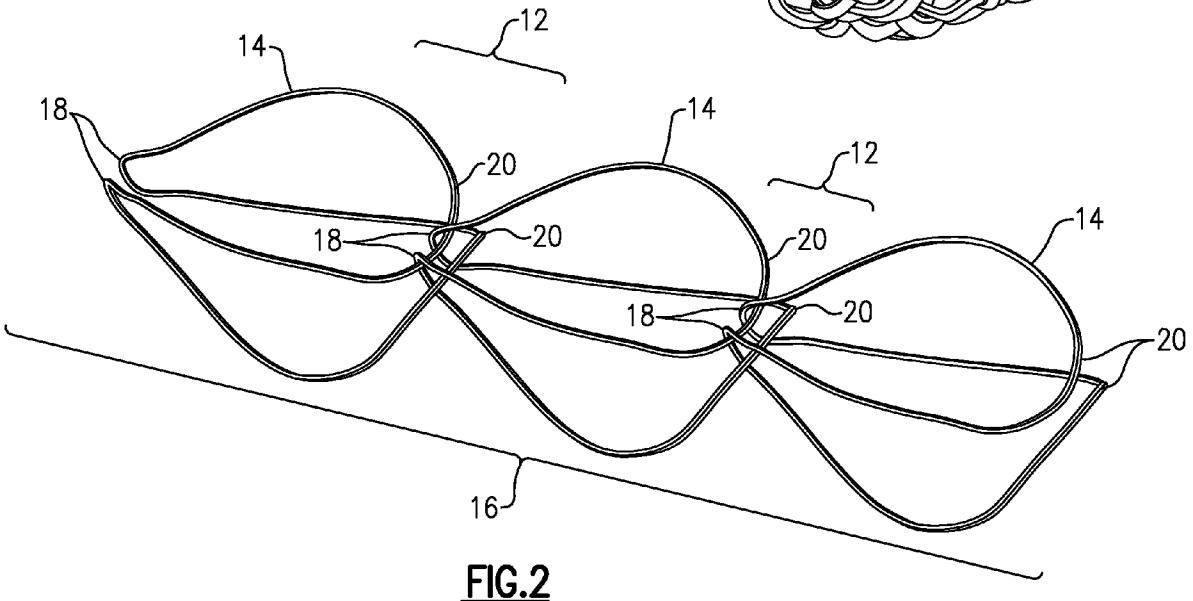
FIG. 2 is a schematic view of an example Brunnian link formed from elastic bands.

Referring to FIGS. 1 and 2, a Brunnian link 12 is formed from a continuous looped structure 14 without forming an actual knot. Several links 12 are formed into a chain 16 to form a linked article such as a bracelet 10. The ends are then secured and a durable wearable item 10 is created. In this example three closed looped elastic bands 14 such as rubber bands are shown forming a single chain. Capturing ends 18 of one elastic band 14 with a mid portion 20 of another elastic band 14 forms each link 12. Each link 12 depends on the previous and subsequent links 14 to maintain the desired linked article.

Figures 3, 4:
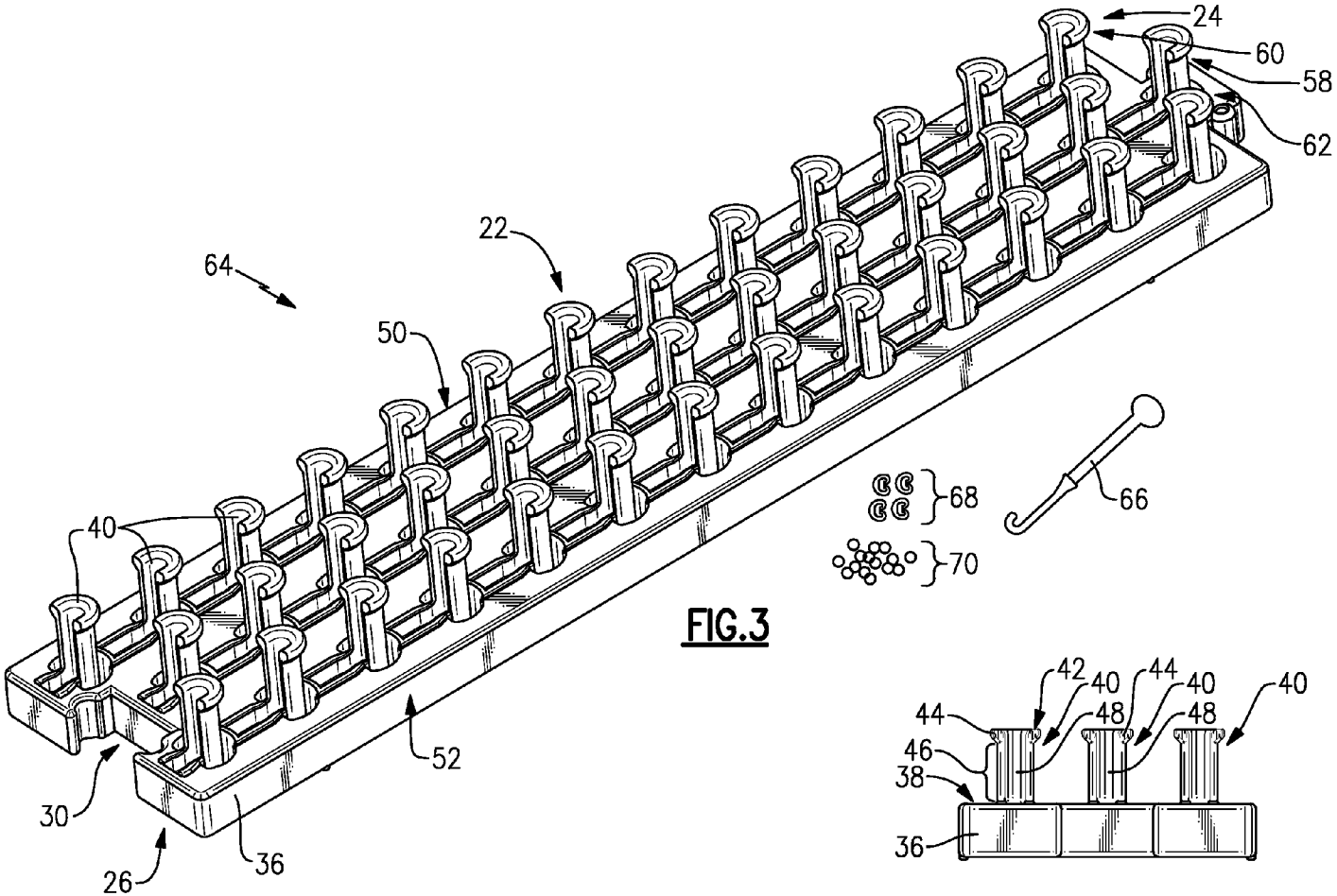
FIG. 3 is a schematic view of an example kit for making Brunnian link articles from elastic bands.
FIG. 4 is a sectional view of an example loom.

Referring to FIGS. 3 and 4, an example kit 64 for creating Brunnian link items such as bracelets and other wearable or decorative items includes a loom 22, a hook 66, a plurality of clips 68 and a plurality of elastic bands 70. The loom 22 includes a base 36 and a plurality of pins 40 standing up from the base 36. The base 36 includes a first surface 38 from which the pins 40 extend. Each of the pins 40 includes a top surface 42 and a flange 44 for holding an elastic band in a desired orientation. In this example, the flange 44 extends from a first side of the access groove 48 to a second side of the access groove 48.

Figure 5:
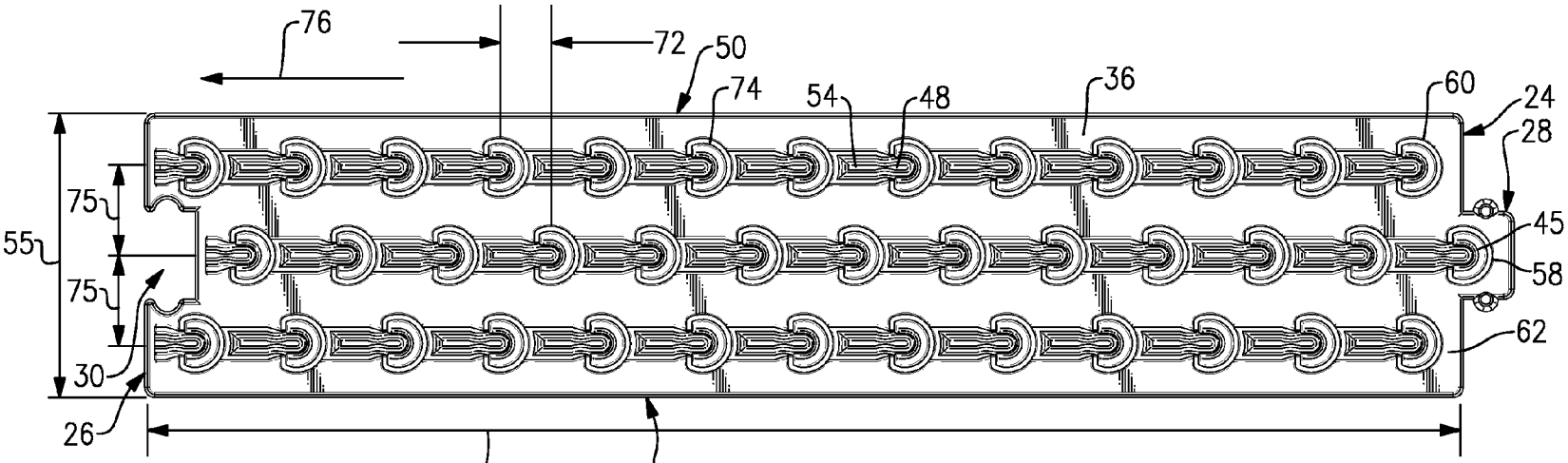
FIG. 5 is a top view of an example loom.
Figure 6:
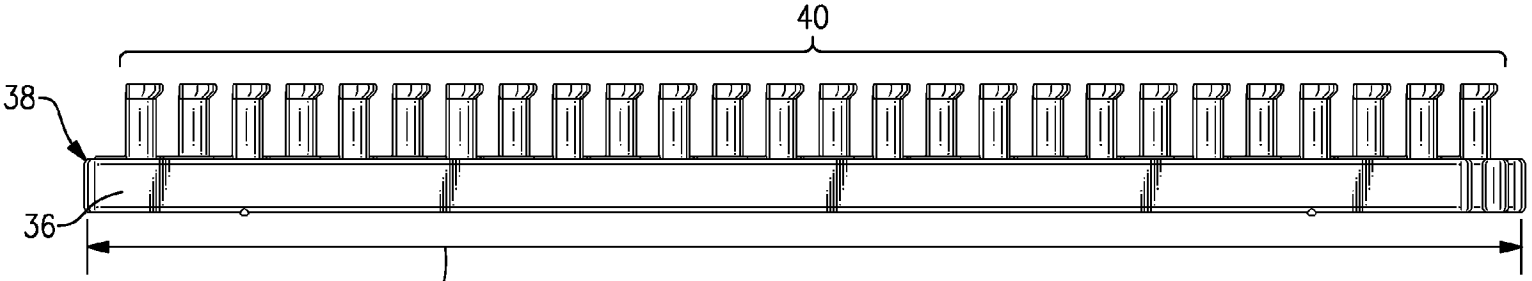
FIG. 6 is a side view of the example loom.

Referring to FIGS. 5 and 6 with continued reference to FIGS. 3 and 4. The base 36 includes a length 56 and a width 55. The base 36 includes a first end 24, a second end 26, a first side 50 and a second side 52. The pins 40 stand up from the base 36. Each of the pins 40 includes a body portion 46 including on one side an access groove 48 extending through the top surface 42 and flange 44. The body portion 46 includes a rounded shape on a side opposite the access groove 48 for supporting an elastic band. Each of the access grooves 48 is open in a common direction 76. In the disclosed example, the access grooves all point toward the second end 26. An opening 74 partially surrounds each pin 40 and extends through the first surface 38 of the base 36.

Figure 7:
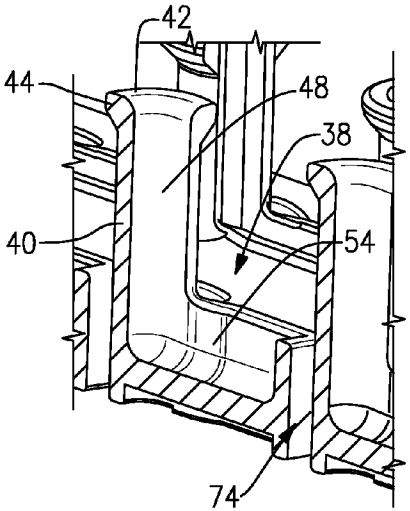
FIG. 7 is a sectional view through a pin of the example loom.

Referring to FIG. 7, with continued reference to FIGS. 4, 5 and 6, the base 36 includes slots 54 that extend below the first surface 38 and that are in communication with a corresponding one of the access grooves 48. The slot 54 provides for the hook 66 to extend below the first surface 38 to capture a bottom or lower most elastic band supported on the pin 40. During fabrication of a linked article, one elastic band is captured and pulled upward within another elastic band supported on a common pin 40. The hook 66 can therefore extend through the access groove 48 into the slot 54 to capture a lower most elastic band and pull that elastic band through the slot 54 and an upper elastic band. The slot 54 extends forward from the pin 40 and access groove 48.

The plurality of pins 40 are arranged in rows that extend a longitudinal length 56 of the loom 22 between the first end 24 and the second end 28. In this disclosed example, the rows include at least one center or intermediate row 58 disposed between an outer first row 60 and an outer second row 62. The intermediate row 58 and first and second outer rows 60,62 are spaced apart from each other in a direction transverse to the longitudinal length 56 an equal distance 75. The intermediate row 58 is staggered or offset relative to the first and second rows 60, 62 on each side. Accordingly, in this example, the intermediate row 58 includes pins 40 that are staggered or offset a distance 72 longitudinally relative to pins 40 in the first outer row 60 and the second outer row 62. The intermediate row 58 in the disclosed example includes a single pin 45 that is spaced forward of the other pins 40 at the first end 24.

Each of the slots 54 and access grooves 48 for each of the pins 40 face in a common direction 76. The common direction 76 in the disclosed loom 22 is toward the second end 26 and away from the first end 24.

Figure 8:
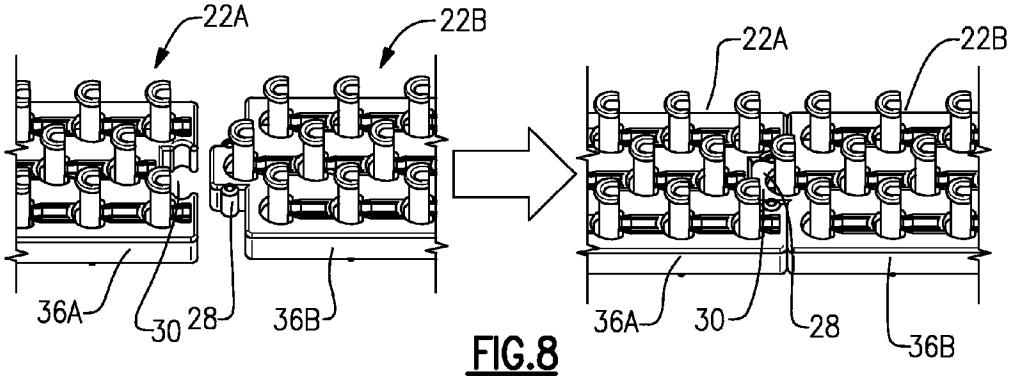
FIG. 8 is a schematic view of a connection between two looms.

Referring to FIG. 8, with continued reference to FIG. 5, the base includes a tab 28 on the first end 24 and a slot 30 on a second end 26 for connecting the base 36A of one loom 22A with the base 36B of another or second loom 22B. Connection of multiple looms 22 provides additional possible link combinations and lengths. In this example, the tab 28 and slot 30 are provided on respective first and second ends 24, 26; however, such connecting features are also contemplated on the first and second sides 50, 52.

Figure 10:
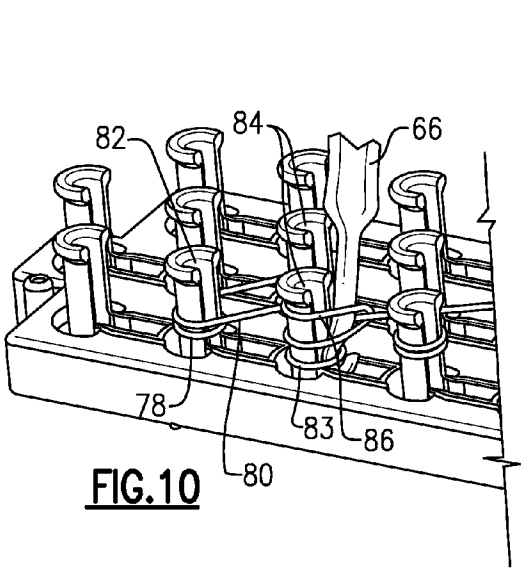
FIG. 10 is a schematic view of a second position for capturing an elastic band.
Figure 9:
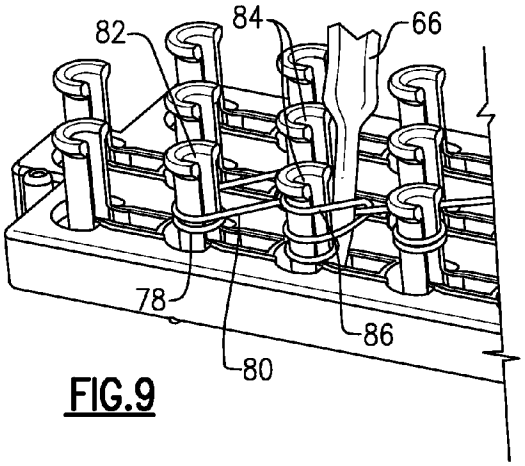
FIG. 9 is a schematic view of a first position for capturing an elastic band.

Referring to FIGS. 9 and 10 with continued reference to FIGS. 3-7, the slots 54 provide for the hook 66 to pick and engage an elastic band in two positions. One position, shown in FIG. 9, is with the hook 66 facing into the access groove 48. A second position, shown in FIG. 10, is with the hook 66 facing outward from the access groove 48. The slot 54 within the base 36 is in direct communication with the access groove 48 so that the hook 66 can move from the access groove 48 into the slot 54 under a lower most elastic band 83 supported on the pin 40. The lower most elastic band 83 can then be pulled through the access groove 48 and through upper elastic bands supported on the same pin 40.

A disclosed method of creating a linked item utilizing the loom 22 includes the step of stretching a first elastic band 78 across adjacent first and second pins 82, 84. The flange 44 holds the elastic band 78 on the first and second pins 82, 84 and prevents the elastic band from slipping off. A second elastic band 80 is stretched across second pin 84 and a third pin 86. The second elastic band 80 is supported on the second pin 84 above the first elastic band 78. A link is formed by capturing and pulling an end of the first band 78 through the access groove and the second band 80 and placing the captured end onto an adjacent pin that in this example is the first pin 82. This forms the Brunnian link and holds the link in place so that additional links can be formed and joined to existing links.

The hook 66 is utilized to capture ends of an elastic band and is inserted through the access groove 48 into the slot 54 and below the lower most elastic band that in this example is the first band 78. The hook 66 is used to grasp the elastic band 78 and pull the elastic band upward through the access groove 48 and within an elastic band above the lower elastic band to form the Brunnian link. The captured end of one of the plurality of elastic bands is pulled over the other end and captured on an adjacent pin while engaged with a second one of the plurality of elastic bands. Capturing and pulling subsequent ends of different ones of the plurality of elastic bands is repeated to form the desired link pattern.

Accordingly, the example kit and method provide for the creation of many different combinations and configurations of Brunnian links for the creation of bracelets, necklaces, and other linked items. Moreover, the example kit is expandable to further create and expand the capabilities of potential Brunnian link creations. The example kit provides for the creation of such links and items in an easy manner allowing persons of varying skill levels to be successful in creating unique wearable items.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A loom for creating an item consisting of a series of links, the device comprising:

a base having a length and width; and a plurality of pins standing up from the base, each of the plurality of pins respectively include a flange near a top surface for holding an elastic link in a desired orientation, and an access groove extending through the top surface, wherein the plurality of pins are arranged in at least three rows spaced an equal distance apart in a direction transverse to the length.

2. The loom as recited in claim 1, wherein the base includes a slot open to the access grove that extends below a first surface of the base to provide access for a tool below the first surface.

3. The loom as recited in claim 1, wherein each of the access grooves are orientated in a common direction.

4. The loom as recited in claim 2, wherein the access grooves are orientated in a direction common with the corresponding slot.

5. The loom as recited in claim 2, wherein the access grooves are orientated in a direction parallel with the length.

6. The loom as recited in claim 1, wherein pins in at least one of the at least three rows are staggered relative to pins in another of the at least three rows.

7. The loom as recited in claim 6, wherein that at least three rows includes at least one intermediate row disposed between outer rows.

8. The loom as recited in claim 7, wherein the intermediate row is offset relative to the outer rows.

9. The loom as recited in claim 8, wherein the outer rows are spaced an equal distance from the at least one intermediate row.

10. The loom as recited in claim 1, wherein the loom includes a first end spaced apart from a second end and the access groove for each of the plurality of pins opens toward the first end.

11. The loom as recited in claim 1, wherein the flange extends about the pin from a first side of the access groove to a second side of the access groove.

12. The loom as recited in claim 11, wherein the access groove extends through the flange and the top surface.

13. The loom as recited in claim 1, wherein the base includes an opening through the first surface at least partially surrounding each of the plurality of pins.

14. The loom as recited in claim 1, wherein the base includes at least one mating feature for connecting a first base of a first loom to a second base of a second loom.

15. The loom as recited in claim 14, wherein the at least one mating feature is disposed on at least one of a first end and a second end of the first base and the second base.

16. A device for creating a series of links comprising:

a base including a length and a width;

a plurality of pins standing up from the base, each of the plurality of pins respectively including a top portion for holding a link in a desired orientation and an access groove facing in a common direction of each of the plurality of pins, wherein the plurality of pins comprises rows of offset pins spaced apart and extending upward from a base.

17. The device as recited in claim 16, including a flange near the top portion for holding a link in place on at least one of the plurality of pins.

18. The device as recited in claim 16, wherein each of the access grooves face toward one end of the base.

19. The device as recited in claim 16, wherein the base includes a slot open to the access grove that extends below a surface to provide access for a tool below the first surface.

20. The device as recited in claim 19, wherein the slot faces in a direction common with the access groove.

21. The device as recited in claim 16, wherein the base includes connecting feature for connecting one base to a second base.

22. A method of creating a linked item from a plurality of elastic bands comprising the steps of:

stretching a first elastic band across a first pin and a second pin;

stretching a second elastic band across the second pin and a third pin over the first elastic band on the second pin;

capturing an end of the second elastic band on the second pin; and pulling the captured end of the second elastic band through the first elastic band and onto the third pin to form a link.

23. The method as recited in claim 22, wherein capturing an end of the second elastic band comprises extending a hook into an access groove and capturing the end with the hook.

24. The method as recited in claim 23, including extending the hook into a slot open to the access groove for capturing the end of the second elastic band.

25. The method as recited in claim 22, including stretching subsequent elastic bands over adjacent pins and preceding elastic bands and pulling subsequent ends of different ones of the plurality of elastic bands to form a desired number of links.

26. The method as recited in claim 22, including the step of connecting a first base with a second base to define a spatial orientation for a plurality of pins.

* * * * *